US005653088A

United States Patent [19]

Cline

[11] Patent Number: 5,653,088

[45] Date of Patent: Aug. 5, 1997

[54] APPARATUS AND METHOD FOR ATTACHING AN INDIVIDUAL FINGER TO A BIRDIE BLOCK

[76] Inventor: Bobby G. Cline, 2727 Bella Vista St., Lakeland, Fla. 33809-8713

[21] Appl. No.: 588,426

[22] Filed: Jan. 18, 1996

[51] Int. Cl.[6] ..... B65B 39/02

[52] U.S. Cl. ..... 53/248; 53/262; 29/453

[58] Field of Search ..... 53/248, 262, 261, 53/247; 29/453, 452

[56] References Cited

U.S. PATENT DOCUMENTS

| | | | |
|---|---|---|---|
| 3,561,189 | 2/1971 | Raudat | 53/248 X |
| 3,788,034 | 1/1974 | Hartness et al. | 53/248 |
| 3,908,339 | 9/1975 | Kennedy et al. | 53/248 |
| 3,911,647 | 10/1975 | Hartness et al. | 53/262 X |
| 4,044,530 | 8/1977 | Phillips | 53/248 |
| 4,171,603 | 10/1979 | Wiseman | 53/248 |
| 4,215,521 | 8/1980 | Hartness | 53/248 |
| 4,439,974 | 4/1984 | Wiseman | 53/248 |
| 4,448,009 | 5/1984 | Raudat | 53/248 |
| 4,589,245 | 5/1986 | Kroeber et al. | 53/262 X |
| 4,608,804 | 9/1986 | Wild | 53/262 |
| 4,633,643 | 1/1987 | Wood | 53/248 |
| 5,392,587 | 2/1995 | Crouch | 53/248 |

*Primary Examiner*—James F. Coan
*Attorney, Agent, or Firm*—David W. Pettis, Jr., P.A.

[57] ABSTRACT

An improved apparatus and method are described for attaching a finger to a birdie block without affecting the attachment of other fingers to the birdie block. A finger may be attached to a birdie block that includes a lower portion in which a plurality of radially spaced apart notches are formed, with a ring and a spring being disposed around the notches of the lower portion to engage the finger and thereby resiliently attach the finger to the birdie block.

15 Claims, 5 Drawing Sheets

APPARATUS AND METHOD FOR ATTACHING AN INDIVIDUAL FINGER TO A BIRDIE BLOCK

BACKGROUND OF THE INVENTION

This invention relates generally to an apparatus and method for attaching an individual finger to a birdie block. More particularly, it relates to a means for attaching at least one finger to a birdie block without affecting the attachment of any other of the fingers to the block.

Finger attachments of the type described herein are generally used in conventional grid-type case packing machines such as that described in U.S. Pat. No. 3,788,034 to Thomas P. Hartness. In general, such packing machines insert articles, such as bottles, into a container or carton through a grid set in order to position the articles in a predetermined position within the container. Typically, the articles are fed by a conveyor into a predetermined relation above a grid that includes a plurality of birdie blocks positioned at predetermined positions along the grid. Each of the birdie blocks includes a plurality of fingers extending therefrom, such that, as the articles pass through the grid between adjacent birdie blocks, the fingers may guide the articles into appropriate receptacles within the container. The fingers typically are either flexible or are pivotally mounted to the birdie blocks, such that a plurality of fingers from adjacent blocks may cooperate to guide the articles to a preferred position within the individual receptacles within the container.

Numerous grid sets and attachment methods have been proposed. However, thus far, such approaches generally fail to completely address the needs of the packing industry. Typically, a relatively significant amount time may be required to replace broken or damaged fingers in packing machines having conventional finger attachments, as there are generally numerous component parts. In addition, many conventional finger attachments require a burdensome disassembly of the birdie block and fingers attached thereto in order to replace or attach a single finger.

SUMMARY OF THE INVENTION

In view of the foregoing, it is an object of this invention to provide an apparatus and method for attaching individual fingers to a birdie block without affecting the attachment of any other fingers to the block. It is another object to provide a finger attachment to the birdie block that enables the fingers to resiliently move in their attachment to the block. It is a further object to provide a simplified means of attachment and method for attaching and replacing broken or damaged fingers to a birdie block. It is also desired to provide a dependable and sturdy means for attaching a finger to a birdie block that generally includes relatively few component parts.

To achieve the foregoing and other objects, the present invention provides an improved apparatus and method for attaching a plurality of fingers to a birdie block without affecting the attachment of any other of the fingers to the block. The apparatus includes a birdie block having four radially spaced notches formed on one end of the block, with each of the notches being separated from each adjoining notch by a lower birdie wall and being dimensioned and configured to receive a segment of a finger therein. Each of the lower birdie walls includes a pair of slots formed substantially transversely of each respective wall and positioned in a vertically spaced apart relation to each other, with a second one of the slots being distal with respect to a first one of the slots. A ring is disposed around the lower end of the block in the first slots, and a spring is disposed around the lower end of the block in the second slots. A finger having an upper segment that is dimensioned and configured to be received onto the birdie block within one of the notches includes a pair of grooves formed therein. A first one of the grooves axially aligns with adjacent ones of the first slots in the birdie wall, whereby the ring engages the first groove, and a second one of the grooves radially aligns with adjacent ones of the second slot in the respective birdie walls, whereby the spring engages the second groove.

A method for attaching a first finger to such a birdie block includes inserting the upper segment of the first finger into a passage between the ring and a notch of the birdie block and sliding the upper segment of the first finger upward through the passage and within the notch such that the second groove of the upper segment of the first finger engages the spring and the first groove of the upper segment of the first finger engages the ring, whereby the finger is resiliently attached to the block.

BRIEF DESCRIPTION OF THE DRAWINGS

A preferred embodiment of the present invention is illustrated in the drawings in which.

Similar reference characters refer to similar parts throughout the several views of the drawings.

DETAILED DESCRIPTION

Figure 1:
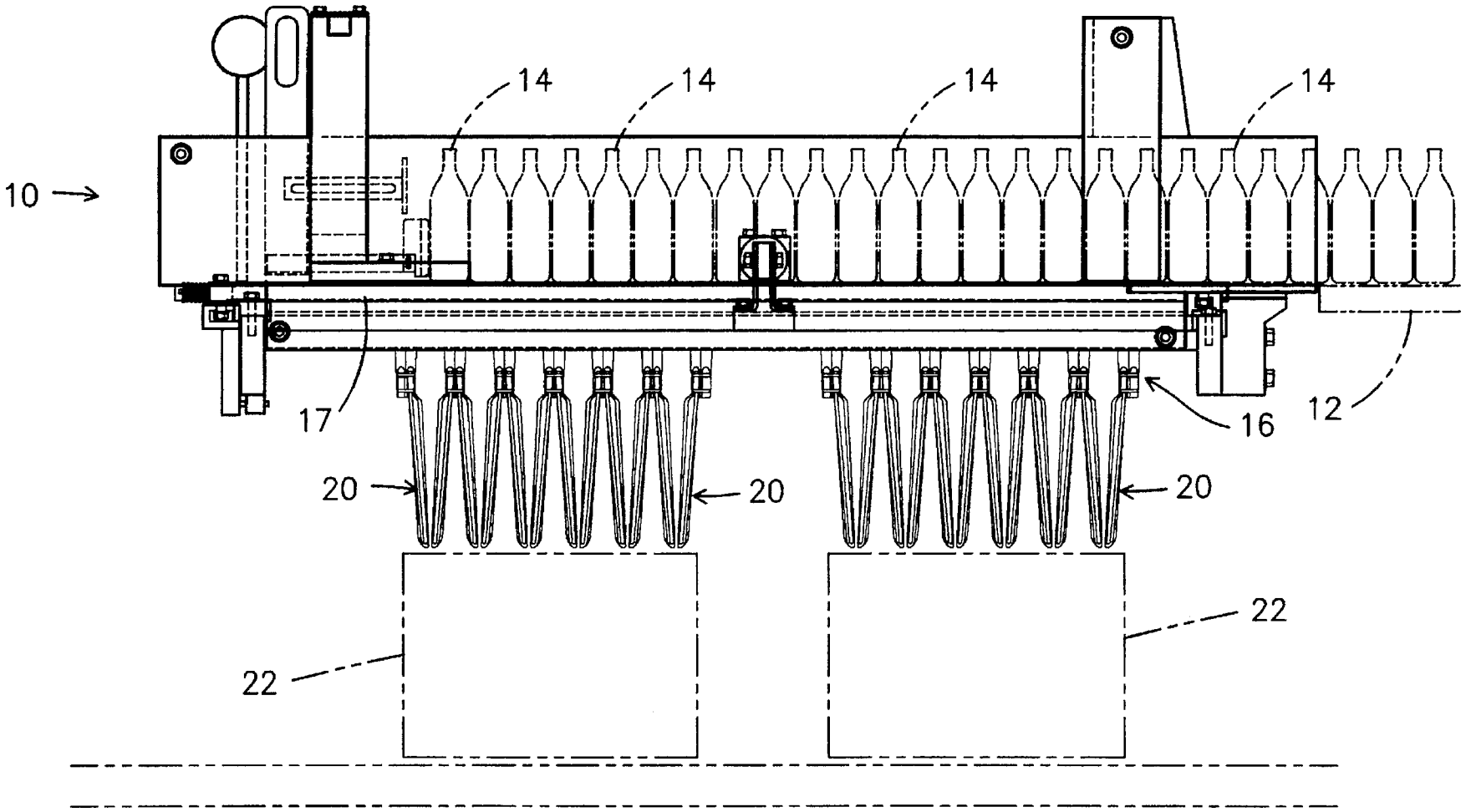
FIG. 1 is a side view of an article inserting machine that includes a plurality of fingers attached to a plurality of birdie blocks in accordance with the present invention.
Figure 3:
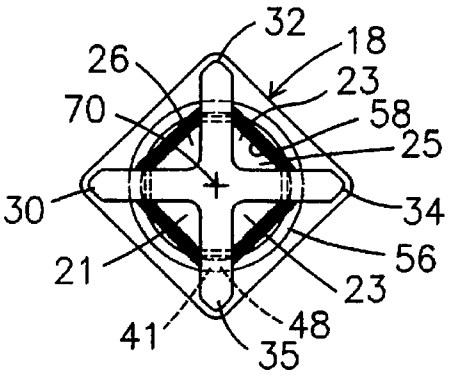
FIG. 3 is a bottom end view of a birdie block in accordance with the present invention.
Figure 2:
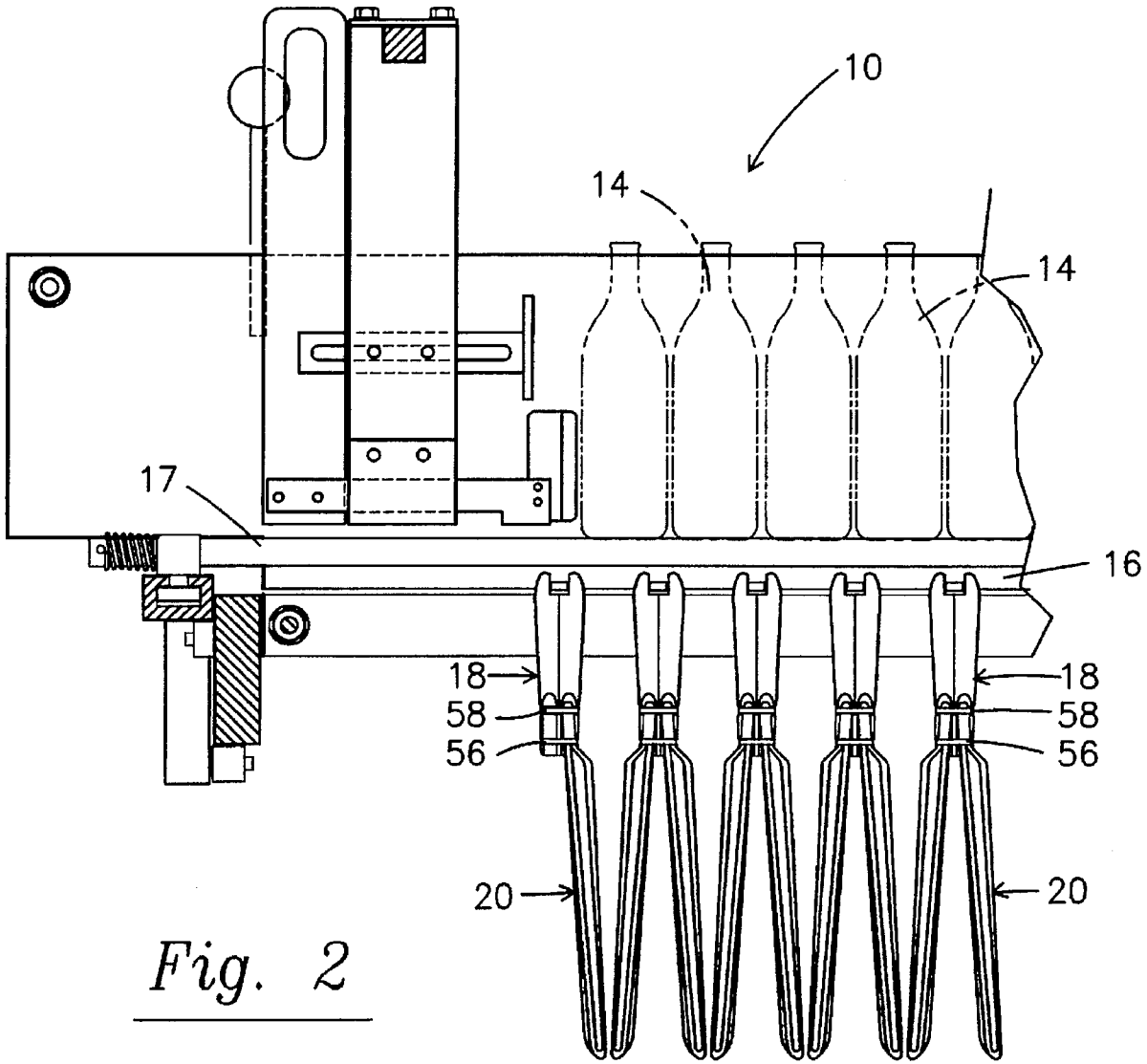
FIG. 2 is an enlarged fragmentary view of the fingers attached to the birdie blocks of the article inserting matching of FIG. 1.

A preferred embodiment of the present invention illustrated in the context of a conventional grid set packing machine is shown in FIGS. 1 and 2. Suitable grid set article inserting machines 10 are well know to those skilled in the art and generally include a conveyor belt 12 that moves a plurality of articles 14, such as bottles, into a predetermined alignment on a support means 17 positioned above a grid set, generally indicated as 16, defined by a plurality of birdie blocks 18. After the articles are appropriately positioned above the grid 16, a detection device typically triggers the articles 14 to be released and pass through the grid 16 that includes the plurality of birdie blocks 18. Each birdie block 18 preferably includes at least one, and suitably four, fingers 20 extending downwardly from the block 18 generally toward a receptacle of a container or carton 22, shown in FIG. 1. Accordingly, the article inserting apparatus 10 releases the articles 14 from the support means 17, and those articles pass through the grid set 16 where the plurality of fingers 20 cooperatively guide the articles 14 into appropriate compartments of the container 22. Preferably, the birdie blocks 18 are adjustably attached to the grid set 16 in order to accommodate articles 14 of various sizes as well as to support different sized cartons 22.

The apparatus of the present invention generally relates to an improved means for attaching at least one finger 20 to a birdie block 18 without affecting the attachment of any other of the fingers 20 to the block 18. Referring to the preferred embodiments illustrated in FIGS. 3–9, the attaching means 24 of the present invention includes a birdie block 18 that includes four radially spaced notches 21, 23, 25 and 26 formed on one end 28 of the block 18. Each of the notches 21, 23, 25 and 26 are separated from each adjoining notch by respective lower birdie walls 35, 34, 32 and 30. Each of the notches 21, 23, 25 and 26 are dimensioned and configured to receive a segment of one of the fingers 20 therein. Each of the lower birdie walls 30, 32, 34 and 35 includes a pair of slots or channels formed substantially transversely of each of the walls and positioned in a vertically spaced apart relation to each other. Each respective first slot 42, 44, 46 and 48 is preferably dimensioned and configured to receive an annular ring 56 with each respective second slot 36, 38, 40 and 41 being dimensioned and configured to receive a biasing means 58, which may conveniently be a tension spring with the ends joined to form a resilient loop. In each respective birdie wall, a second slot 36, 38, 40 and 41 is preferably spaced from a first one of the slots 42, 44, 46 and 48, respectively. In addition, each of the first slots 42, 44, 46 and 48 is positioned generally adjacent to the one end 28 of the block 18, with each of the second slots 36, 38, 40 and 41 being spaced apart from each respective first slot 42, 44, 46 and 48 a predetermined distance generally equal to the distance between a pair of finger grooves 52 and 54 on finger 20, shown in FIGS. 4–8. In addition, the other end of the block, generally indicated as 29, is dimensioned and configured for adjustable attachment to the gird set 16 of the article inserting machine 10.

The attaching means 24 also includes the ring 56, which is formed preferably of a substantially resilient ferrous material, disposed around the lower end of the block 18 in each of the first slots 42, 44, 46 and 48, defining a passage 61 between the ring 56 and each of the notches 21, 23, 25 and 26. The ring 56 may suitably be an appropriately sized split ring similar to that commonly used in standard key rings. Of course, any conventional structure that may provide an appropriate amount of tension to a finger 20 may suffice. In addition, a spring 58 is disposed around the lower end of the block 18 in each of the second slots 36, 38, 40 and 41. It will be understood that any conventional biasing means, which may suitably be a coil spring, elastic band, or the like, that will enable a finger 20 to engage an article resiliently may be used with equal facility.

As shown in FIGS. 1, 2 and 4–9, the attaching means 24 also includes an upper segment 60 of finger 20, which segment 60 is dimensioned and configured to be received onto the birdie block 18 within one of the notches 21, 23, 25 and 26. The upper segment 60 includes a pair of grooves 52 and 54 formed therein, with a first one of the grooves 52 axially aligning with adjacent ones of the first slot 42, 44, 46 and 48 in the respective birdie block walls 30, 32, 34 and 35 respectively, whereby the ring engages the first groove 52 of the finger 20. The finger 20 also includes a second groove 54 that axially aligns with adjacent ones of the second slot 36, 38, 40 and 41 in the birdie walls 30, 32, 34 and 35 respectively, whereby the spring 58 engages the second groove 54 of the finger 20.

In the preferred embodiment illustrated in FIGS. 1, 2 and 4–9, each finger further includes an elongated lower segment 62 that is dimensioned and configured for guiding the articles 14 into the carton 22. In addition, the upper segment 60 of each finger 20 also includes an inner surface 64 and an outer surface 66, the inner surface 64 of which is dimensioned and configured for preferably matingly engaging one of the notches 21, 23, 25 and 26 of the block 18. The outer surface 66 of the upper segment 60 is generally arcuate along at least a portion of its length. Preferably, the upper segment 60 of each finger 20 is generally tapered lengthwise along its arcuate outer surface 66 intermediate the pair of grooves 52 and 54. As shown in FIGS. 4–9, the outer surface 66 of the upper segment 60 includes a width that generally decreases from the second groove 54 to at least the first groove 52. In the preferred embodiment illustrated in the figures, the upper segment 60 of each finger 20 is illustrated to include a generally semi-spherical tip 68 positioned distal the lower segment 62. Generally, the tapered upper segment 60 and the semi-spherical tip cooperate to facilitate the insertion of a finger 20 between the ting 56 and one of the notches 21, 23, 25 and 26 as well as subsequently between the spring 58 and a respective one of the notches 21, 23, 25 and 26, shown in FIGS. 6–9.

As shown in FIGS. 3–9, the birdie block 18 preferably includes a longitudinal axis 70 extending through the center of the birdie block 18. The lower segment 62 of each finger 20 is preferably attached to the upper segment 60 such that the generally mating engagement of the inner surface 64 of the upper segment 60 with a respective notch 21, 23, 25 or 26, which may suitably be caused by the spring 58 engaging the second groove 54 of the upper segment 60, resiliently positions the lower segment 62 angled outwardly from the longitudinal axis 70 of the birdie block 18. As shown in FIGS. 1 and 2, as an article 14 passes between adjacent ones of the fingers 20, the engagement between the article 14 and the lower segment 62 of the finger 20 will cause the lower segment 62 to move inwardly about a fulcrum point created by the engagement between ring 56 and the first groove 52 towards the axis 70 against the bias of the spring 58. Accordingly, the amount of guidance provided by the fingers 20 to the articles 14 generally relates to the amount the tension applied by the spring 58 to the second groove 54 of the upper segment 60 of the finger 20.

As shown in FIGS. 4–9, each of the birdie walls 30, 32, 34 and 35 preferably are integral with the birdie block 18. In addition, in a preferred embodiment of the present invention, the lower birdie walls 30, 32, 34 and 35 may be formed of a resilient thermoplastic resin, suitably polyethylene, such that as an upper segment 60 of a finger 20 is inserted between the resilient ring 56 and an adjacent pair of birdie walls 30 and 32, the resilient nature of the ring 56 and lower birdie walls 30, 32, 34 and 35 cooperate to enable the finger 20 to be resiliently attached to the block 18 and provide its guiding function to the articles 14.

Figure 9:
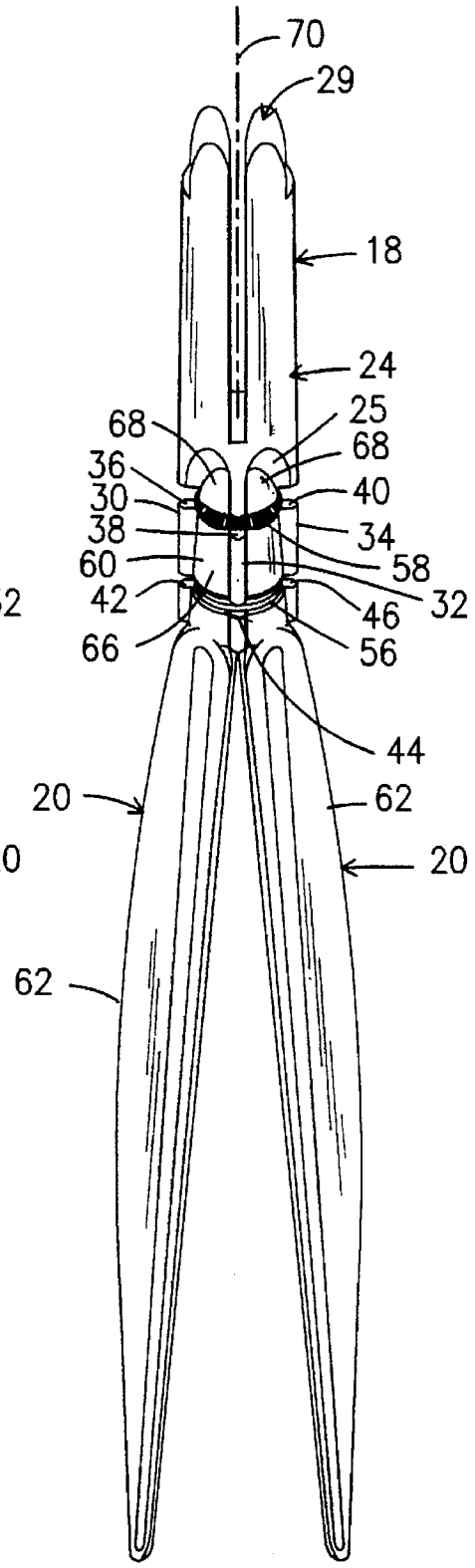

Based on the foregoing description of the preferred means for attaching 24 a finger 20 to a birdie block 18 as illustrated in the figures, it is seen that a finger 20 may be attached to a birdie block 18 without affecting the attachment of any other fingers 20 to the block 18. This may be accomplished, for example, by inserting at the bottom end 28 of the block 18 the tip 68 of the upper segment 60 of a first finger 20 into the passage 61 between the ring 56 and a notch 26 of a birdie block 18 and sliding the upper segment 60 of the first finger 20 upward through the passage 61 and within the notch 26 such that the first groove 52 of the upper segment 60 of the finger 20 engages the ring 56 and the second groove 54 of the upper segment 60 engages the spring 58, whereby the first finger 20 is resiliently attached to the block 18 as shown in FIG. 9. In addition, the second groove 54 and the thickness of the finger upper segment 60 adjacent that groove 52 are preferably of suitable size as not to engage the ring 56, but rather pass beneath the ring 56 substantially unobstructed by the ring 56, shown in FIG. 8. Thus, by urging the second and first grooves into engagement with the spring 58 and ring 56, respectively, a desired resilient attachment may be achieved between the finger 20 and a respective notch 21, 23, 25 and 26 of the birdie block 18.

Figure 4:
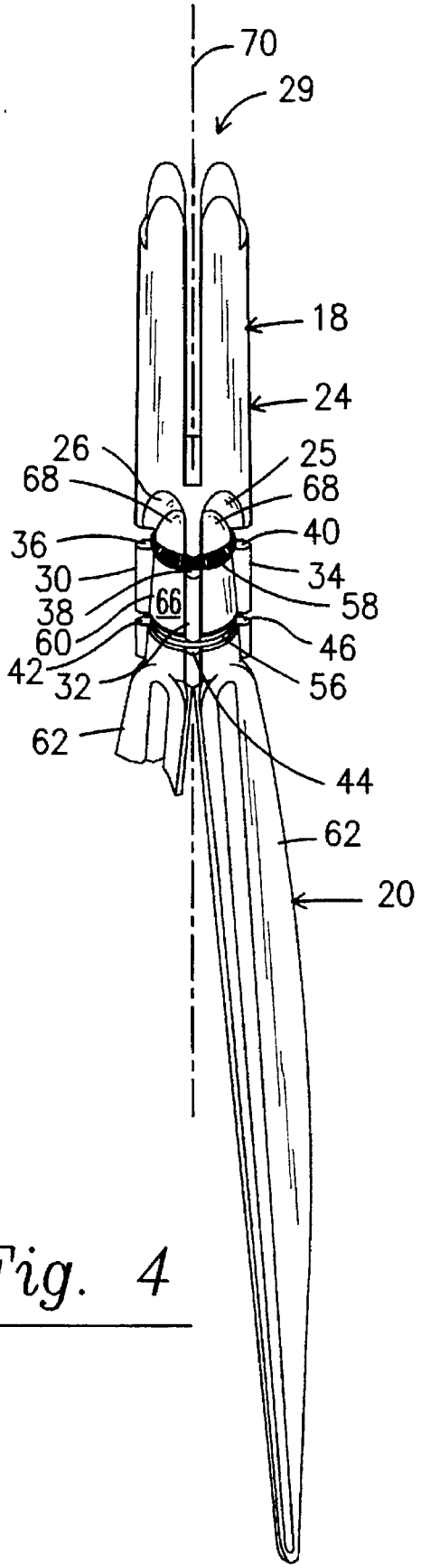
FIG. 4 is a side elevation of a birdie block and finger attachment means in accordance with the present invention.
Figure 5:
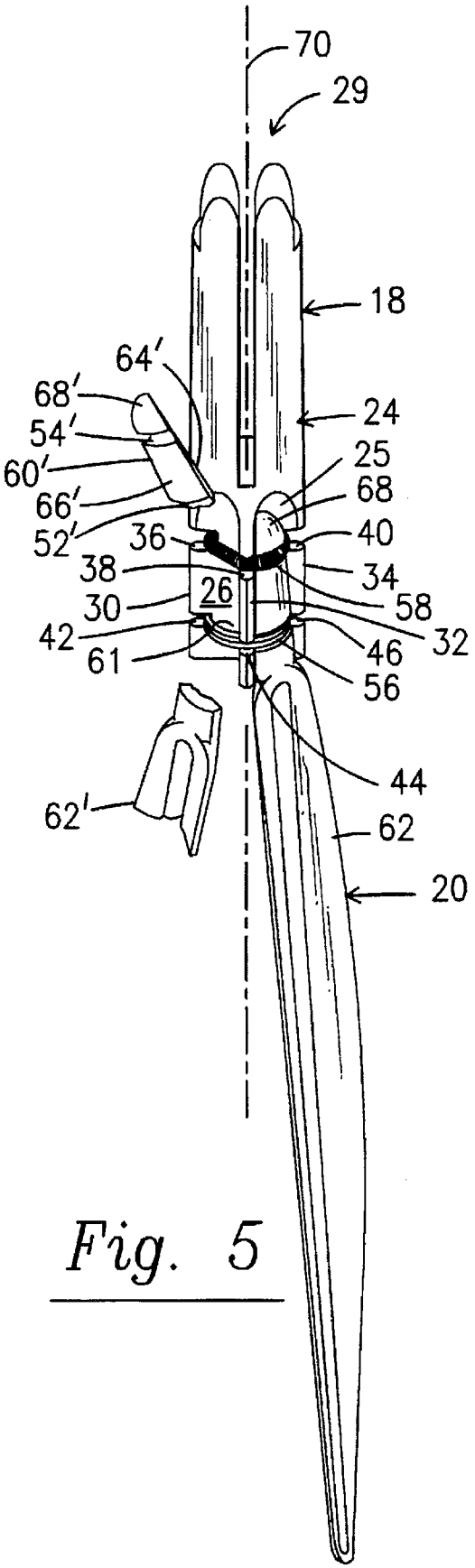
FIG. 5–9 are side elevations according to FIG. 4, but illustrating the steps in removal and replacement and replacement of a broken finger.
Figure 6:
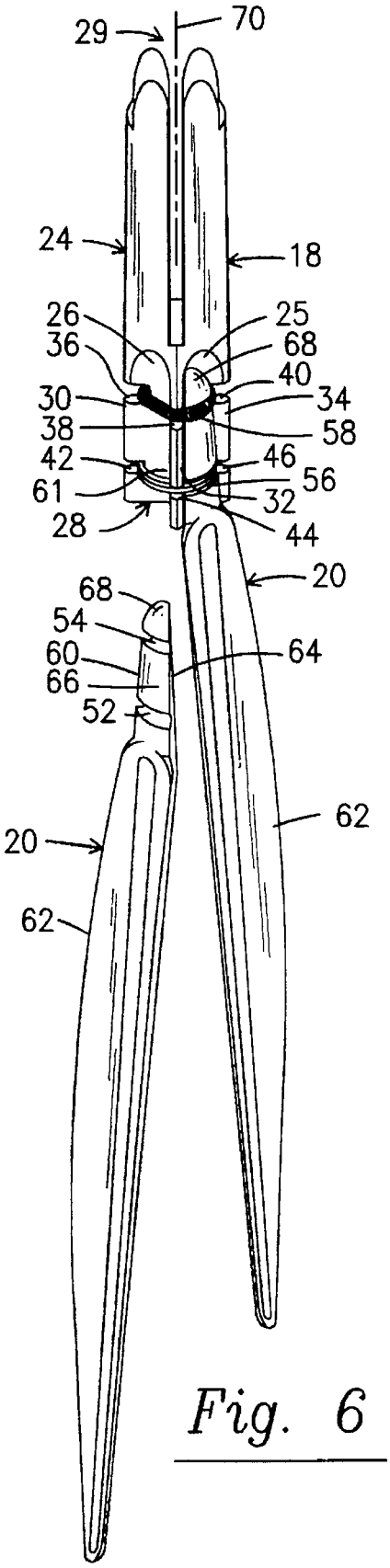
Figure 7:
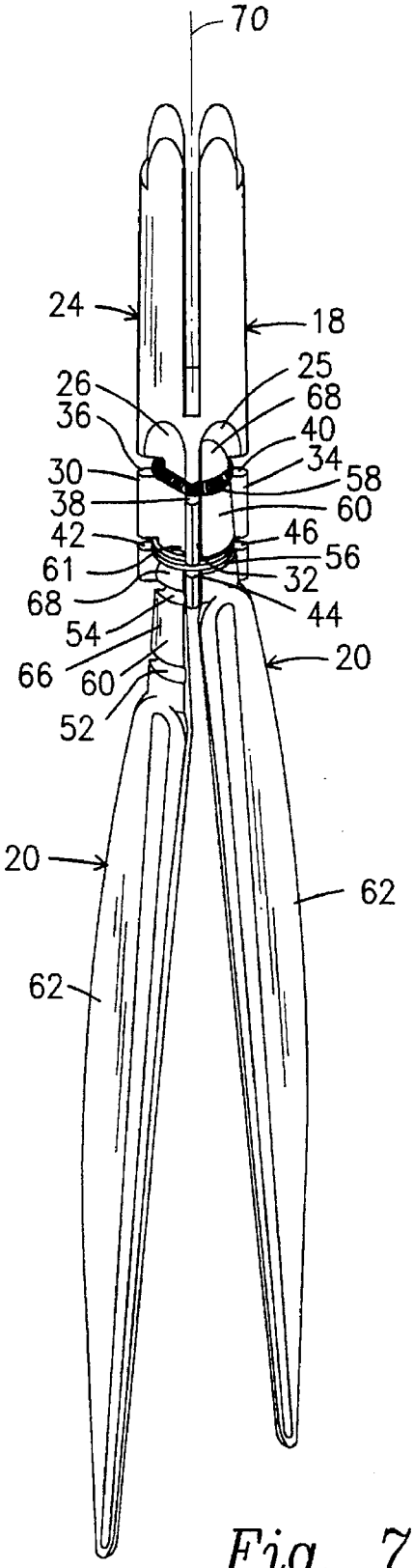
Figure 8:
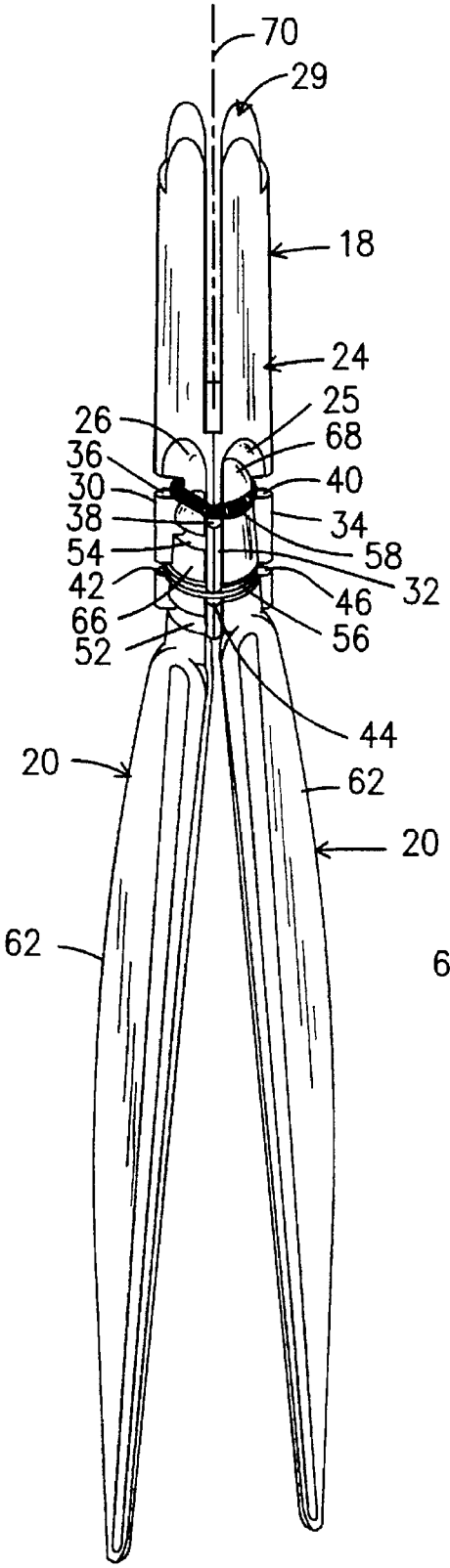

In the situation where a second finger that is attached to the birdie block 18 is damaged or otherwise requires replacement, the second finger may be removed from the birdie block 18 by appropriately removing the lower segment 62' of the second finger, or remaining portion thereof, from the upper segment 60 of the second finger. This method is illustrated in FIGS. 4 and 5 with similar reference numbers, including a prime symbol, indicating corresponding component parts of the second finger. When a finger requires replacement, it typically will be discarded after being removed from the block 18. Thus, the lower segment 62' may be separated from the upper segment 60' by any conventional means. Once the lower segment 62' has been detached from the upper segment 60', the removal of the upper segment 60' from the birdie block 18 may be accomplished by sliding the upper segment 60' upward along the notch 26 and removing the upper segment 60' of the second finger from the notch 26 of the block 18. After the upper segment 60 has been removed from the birdie block 18, a replacement finger 20 accordingly may be inserted into the empty notch 26 as set forth above and illustrated in FIGS. 6–9.

It will thus be seen that the objects set forth above, among those made apparent from the proceeding description, are efficiently attained, and, since certain changes may be made in carrying out the above method and in the construction of the apparatus set forth without departing from the scope of the present invention, it is intended that all matter contained in the above description or shown in the accompanying drawings shall be interpreted as illustrative and not in a limiting since. Accordingly, because numerous variations and modifications of this invention, all within the scope of the invention, will readily occur to those skilled in the art, the scope of the invention is to be limited solely by the claims appended hereto.

What is claimed is:

1. In an apparatus for inserting a plurality of articles into a carton wherein the articles to be inserted pass through a grid set including a plurality of birdie blocks wherein each of said blocks has at least one finger movably attached thereto and extending downwardly from said block generally toward a compartment of the carton, the improvement comprising means for attaching a plurality of said fingers to one of said blocks without affecting the attachment of any other of said fingers to said block; said means for attaching comprising:

a birdie block including four axially spaced notches formed on one end of said block, each of said notches being separated from each adjoining said notch by a lower birdie wall, and each of said notches being dimensioned and configured to receive a segment of one of said fingers therein, each of said lower birdie walls including a pair of slots formed substantially transversely of each said wall and positioned in a vertically spaced apart relation to each other, a second of said slots being spaced from a first one of said slots;

a ring disposed around said lower end of said block in said first slots, a spring disposed around said lower end of said block in said second of said slots;

a finger having an upper segment dimensioned and configured to be received onto said birdie block within one of said notches, said upper segment of said finger so received including a pair of grooves formed therein, with:

a first one of said grooves radially aligning with adjacent ones of said first slots in said birdie wall, whereby the ring engages the first groove; and a second one of said grooves radially aligning with adjacent ones of said second slots in said birdie wall, whereby the spring engages the second groove.

2. The improvement as claimed in claim 1 wherein each of said notches extends generally longitudinally along said block a length at least equal to the length of said upper segment intermediate said pair of grooves.

3. The improvement as claimed in claim 1 wherein each of said first slots is positioned generally adjacent to said one end of said block.

4. The improvement as claimed in claim 3 wherein each of said second slots is spaced apart from each respective said first slot a predetermined distance generally equal to the distance between said pair of finger grooves.

5. The improvement as claimed in claim 1 wherein each said finger further comprises an elongated lower segment dimensioned and configured for guiding said articles into said carton.

6. The improvement as claimed in claim 5 wherein said upper segment of each of said fingers further comprises an inner surface and an outer surface, said inner surface being dimensioned and configured for engaging one of said notches of said block, and said outer surface being generally arcuate along its length.

7. The improvement as claimed in claim 6 wherein said birdie block includes a longitudinal axis extending through the center of said birdie block and wherein said lower segment of each said finger is configured such that the engagement of said inner surface of said upper segment with said surface of a respective one of said notches resiliently positions said lower segment angled outwardly from said longitudinal axis of said birdie block.

8. The improvement as claimed in claim 7 wherein said upper segment of each said finger is generally tapered along its outer surface length intermediate said pair of grooves.

9. The improvement as claimed in claim 8 wherein said arcuate outer surface of said upper segment comprises a width that generally decreases from said second groove to said first groove.

10. The improvement as claimed in claim 9 wherein said upper segment of said finger further comprises a generally semi-spherical tip positioned distal said lower segment, whereby the upper segment of a finger may easily be inserted between the ring and one of the notches.

11. The improvement as claimed in claim 1 wherein said ring comprises a substantially resilient ferrous material.

12. The improvement as claimed in claim 1 wherein each of said lower birdie walls comprises a resilient thermoplastic resin.

13. The improvement as claimed in claim 1 wherein said lower birdie walls are integral with said birdie block.

14. A method for attaching a finger having an upper segment to a birdie block without affecting the attachment of any other fingers to the block in an apparatus for inserting a plurality of articles into a carton wherein the articles to be inserted pass through a grid set including a plurality of birdie blocks wherein each of the blocks includes four axially spaced notches formed on one end of the block, each of the notches being separated from each adjacent said notch by a lower birdie wall, and each of the notches being dimensioned and configured to receive the upper segment of one of the fingers therein, each of the lower birdie walls including a pair of slots formed transversely of each said birdie wall and positioned in a vertically spaced apart relation to each other, a second of the slots being spaced from to a first one of the slots, a ring disposed around the lower end of the block in the first slots defining a passage between the ring and each of the notches, a spring disposed around the lower end of the block in the second of the slots, said method comprising:

inserting the upper segment of a first finger into said passage between said ring and a notch of a birdie block, said first finger having a first groove and a second groove formed therein; and sliding said upper end of said first finger upward through said passage and within said notch such that said first groove of said upper segment of said first finger engages said ring and said second groove of said upper segment engages said spring, whereby the first finger is resiliently attached to said block.

15. A method as claimed in claim 14 wherein said birdie block further includes a second finger having an upper segment and a lower segment attached to and extending from said upper segment, said method further comprising:

removing said lower segment of said second finger from said upper segment of said second finger;

sliding said upper segment of said second finger upward along said notch; and removing said upper segment of said second finger from said notch of said block, whereby the notch is empty and another finger may be inserted into the empty notch.

* * * * *